US011685980B2

(12) United States Patent
Yu et al.

(10) Patent No.: US 11,685,980 B2
(45) Date of Patent: Jun. 27, 2023

(54) METAL SOFT MAGNETIC COMPOSITE MATERIAL INDUCTOR AND PREPARATION METHOD THEREOF

(71) Applicant: Shenzhen Sunlord Electronics Co., Ltd., Guangdong (CN)

(72) Inventors: Xinshu Yu, Guangdong (CN); Shengcheng Xia, Guangdong (CN); Youyun Li, Guangdong (CN); Xin Che, Guangdong (CN)

(73) Assignee: Shenzhen Sunlord Electronics Co., Ltd., Guangdong (CN)

( * ) Notice: Subject to any disclaimer, the term of this patent is extended or adjusted under 35 U.S.C. 154(b) by 111 days.

(21) Appl. No.: 17/211,775

(22) Filed: Mar. 24, 2021

(65) Prior Publication Data

US 2021/0210261 A1 Jul. 8, 2021

Related U.S. Application Data

(63) Continuation of application No. PCT/CN2019/113772, filed on Oct. 28, 2019.

(30) Foreign Application Priority Data

May 7, 2019 (CN) ..... 201910376481.9
May 8, 2019 (CN) ..... 201910380702.X

(51) Int. Cl.
*C22C 38/34* (2006.01)
*B22F 9/08* (2006.01)
(Continued)

(52) U.S. Cl.
CPC ..... *C22C 38/34* (2013.01); *B22F 1/102* (2022.01); *B22F 1/108* (2022.01); *B22F 9/082* (2013.01);
(Continued)

(58) Field of Classification Search
CPC ..... B22F 1/052; B22F 3/004; B22F 3/225
See application file for complete search history.

(56) References Cited

U.S. PATENT DOCUMENTS

2009/0250836 A1* 10/2009 Fukui ..... H01F 41/005 264/272.15
2021/0114091 A1* 4/2021 Ohta ..... B22F 1/054

FOREIGN PATENT DOCUMENTS

CN 101269548 9/2008
CN 102737802 10/2012
(Continued)

OTHER PUBLICATIONS

Alaneme, Kenneth Kanayo, and Eloho Anita Okotete. "Recrystallization mechanisms and microstructure development in emerging metallic materials: A review." Journal of Science: Advanced Materials and Devices 4.1 (2019): 19-33 (available online Dec. 28, 2018) (Year: 2018).*
(Continued)

*Primary Examiner* — Sally A Merkling
*Assistant Examiner* — Sean P. O'Keefe
(74) *Attorney, Agent, or Firm* — Winston Hsu

(57) ABSTRACT

A preparation method for a metal soft magnetic composite material inductor includes: smelting Fe, Si and Cr and then employing a water atomization or gas atomization means to fabricate an alloy powder; after sifting by particle size, mixing powders of different particle size levels and performing coating insulation, and performing post-granulation to obtain a metal soft composite material granulation powder; adopting the granulation powder to press a material cake, and transferring and molding same; adopting a hollow coil in a liquid-phase coating mold cavity, curing and demolding to obtain a semi-finished product, then continu-
(Continued)

(a)

(b)

ously heating and curing the semi-finished product, and preparing an end electrode to obtain a finished inductor.

6 Claims, 3 Drawing Sheets

(51) Int. Cl.

| | |
|---|---|
| ***H01F 1/01*** | (2006.01) |
| ***H01F 1/26*** | (2006.01) |
| ***H01F 41/02*** | (2006.01) |
| ***B22F 1/102*** | (2022.01) |
| ***H01F 3/08*** | (2006.01) |
| ***B22F 1/10*** | (2022.01) |
| ***C22C 1/10*** | (2023.01) |

(52) U.S. Cl.

CPC ..... *C22C 1/1084* (2013.01); *H01F 1/015* (2013.01); *H01F 1/26* (2013.01); *H01F 3/08* (2013.01); *H01F 41/0246* (2013.01); *B22F 2009/0828* (2013.01); *B22F 2301/35* (2013.01); *B22F 2304/10* (2013.01)

(56) References Cited

FOREIGN PATENT DOCUMENTS

| | | | | |
|---|---|---|---|---|
| CN | 103608879 | | | 2/2014 |
| CN | 105405631 | | | 3/2016 |
| CN | 106816252 | | | 6/2017 |
| CN | 109545505 | | | 3/2019 |
| CN | 110164673 | | | 8/2019 |
| JP | 2003092211 | | | 3/2003 |
| JP | 2018186212 | A | * | 11/2018 |
| WO | 2016121950 | | | 8/2016 |
| WO | 2018219367 | | | 12/2018 |

OTHER PUBLICATIONS

CN 106816252 A English language translation (Year: 2017).*

* cited by examiner

（a） （b）

METAL SOFT MAGNETIC COMPOSITE MATERIAL INDUCTOR AND PREPARATION METHOD THEREOF

CROSS REFERENCE TO RELATED APPLICATIONS

The present application is a Continuation Application of PCT Application No. PCT/CN2019/113772 filed on Oct. 28, 2019, which claims the priorities of Chinese Patent Application No. 201910376481.9 filed on May 7, 2019 and Chinese Patent Application No. 201910380702.X filed on May 8, 2019. The contents of all of the above are hereby incorporated by reference.

BACKGROUND OF THE INVENTION

1. Field of the Invention

The application relates to a metal soft magnetic composite material inductor and a preparation method thereof.

2. Description of the Prior Art

In today's era of the rapid development of science and technology, the replacement of electronic products is also very rapid, and people have stricter requirements for the performance and reliability of electronic products so that the electronic components used by electronic products must be updated accordingly. The use voltage, current, frequency and other requirements of inductance elements and inductors are higher and higher, and the traditional powder material mold pressing inductor has many defects so that the pain point of the mold pressing inductor cannot be fundamentally solved.

According to the traditional powder material mold pressing inductor, the powder is filled in an impression, and the powder is extruded to be a product by great pressure. The stress is not uniform in the process, and risks of masked cracks, short circuits, open circuits, and the like exist in the product.

The disclosure of the above background art content is only used to assist the understanding of the inventive concept and technical solution of the present application. It does not necessarily belong to the prior art of this patent application. In the absence of clear evidence that the above content has been disclosed before the filing date of this patent application, the above background art should not be used to evaluate the novelty and inventiveness of this application.

SUMMARY OF THE INVENTION

The application mainly aims at overcoming the defects of the characteristics of the existing powder materials, and provides a metal soft magnetic composite material inductor and a preparation method thereof. The material can be uniformly filled in the impression by adopting the principle of liquid-phase forming with low pressure (avoiding the problem of the masked crack in the inductor product) so that the hollow coil assembly is coated, and the hollow coil is subjected to zero damage, and the risk of short circuit and cracking of the inductor product is avoided.

The application provides the following technical solution for achieving the above purpose:

a preparation method for a metal soft magnetic composite material inductor, including the following steps of:

1) mixing and smelting Fe, Si and Cr according to the following proportion: 85-95 wt % of Fe, 4-10 wt % of Si and 1-5 wt % of Cr to obtain an alloy solution;

2) making the alloy solution into alloy powder in a water atomization or gas atomization means;

3) sifting the alloy powder into a first powder of 15-45 μm, a second powder larger than 45 μm and a third powder smaller than 15 μm according to the particle size;

4) mixing the first powder, the second powder and the third powder according to the following proportion: 60-80 wt % of the first powder, 5-20 wt % of the second powder, 15-35 wt % of the third powder to obtain a mixed powder, and carrying out coating insulation on the mixed powder, 5) crushing, granulating and sifting insulated powder sequentially to obtain granulation powder, and pressing the granulation powder into a material cake;

6) placing a prefabricated hollow coil assembly in a mold cavity, placing the material cake in a storage bin, liquefying the material cake into the mold cavity in a transfer molding process, and coating the coil assembly;

7) curing and demolding, and removing a runner to obtain a semi-finished product; and 8) solidifying the semi-finished product and preparing an end electrode to obtain a finished inductor.

The preparation method provided by the technical solution of the application has the beneficial effects that: the prepared granulation powder can be liquefied during the transfer molding process, has no breath and masked crack in the interior, and has high space utilization rate, higher density and excellent product characteristics; due to the fact that the granulation powder can be liquefied and can be formed by the transfer molding process, a product with good compactness and strength can be obtained at low forming pressure, the stress of a coil in an inductor product is very small, the coil is neither deformed nor damaged, the product has no short circuit and cracking phenomena, and the reliability of the product is higher.

DETAILED DESCRIPTION

Figure 1:
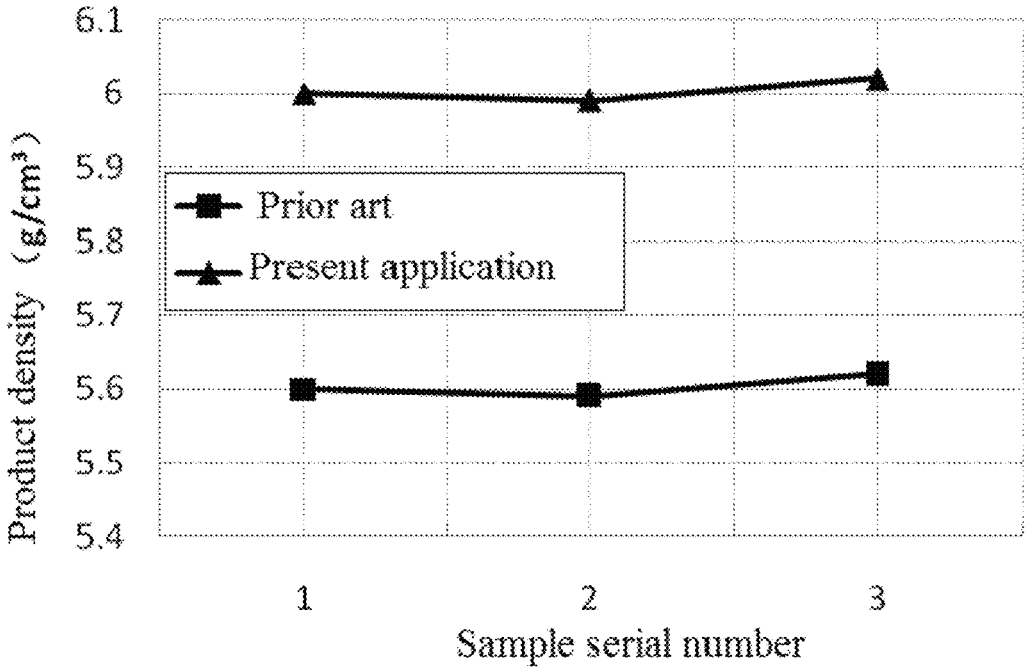
FIG. 1 is a graph comparing the density ("sample serial number" vs "product density") of an inductor according to a specific embodiment of the present application with that of an existing powder integrally formed inductor.
Figure 2:
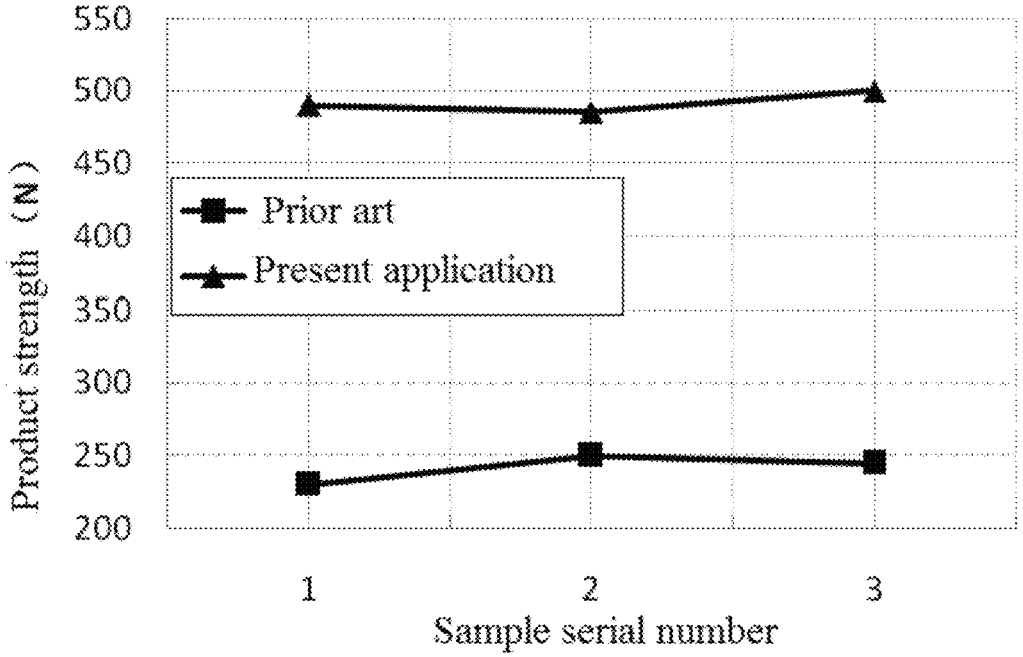
FIG. 2 is a graph comparing the strength ("sample serial number" vs "product strength") of an inductor according to a specific embodiment of the present application with that of an existing powder integrally formed inductor.
Figure 3:
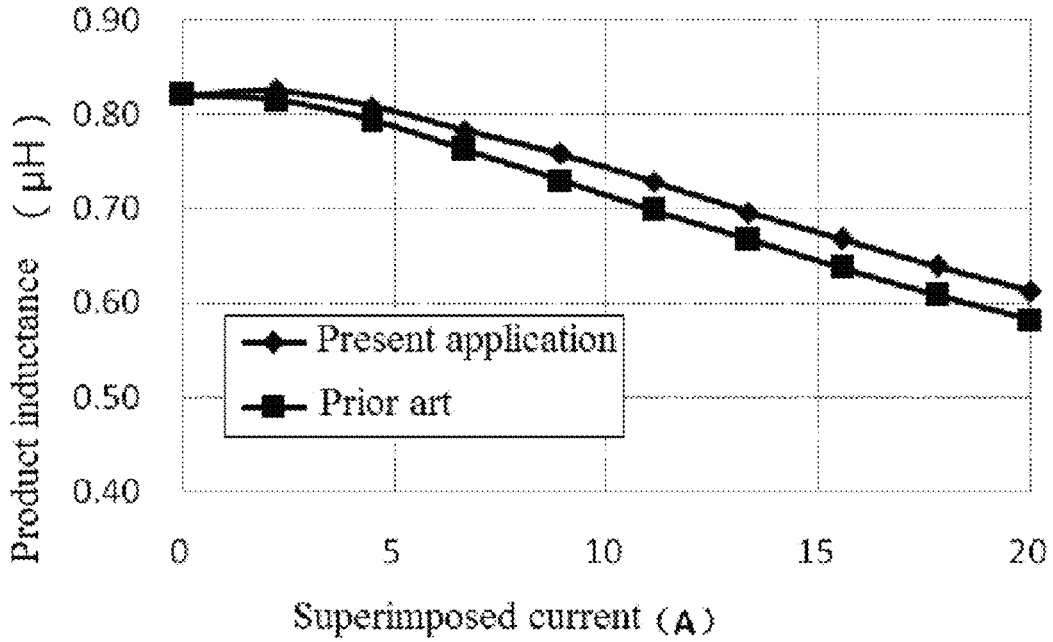
FIG. 3 is a graph comparing saturation characteristics ("superimposed current" vs "product inductance") of an inductor according to a specific embodiment of the present application with that of an existing powder integrally formed inductor.
Figure 4:
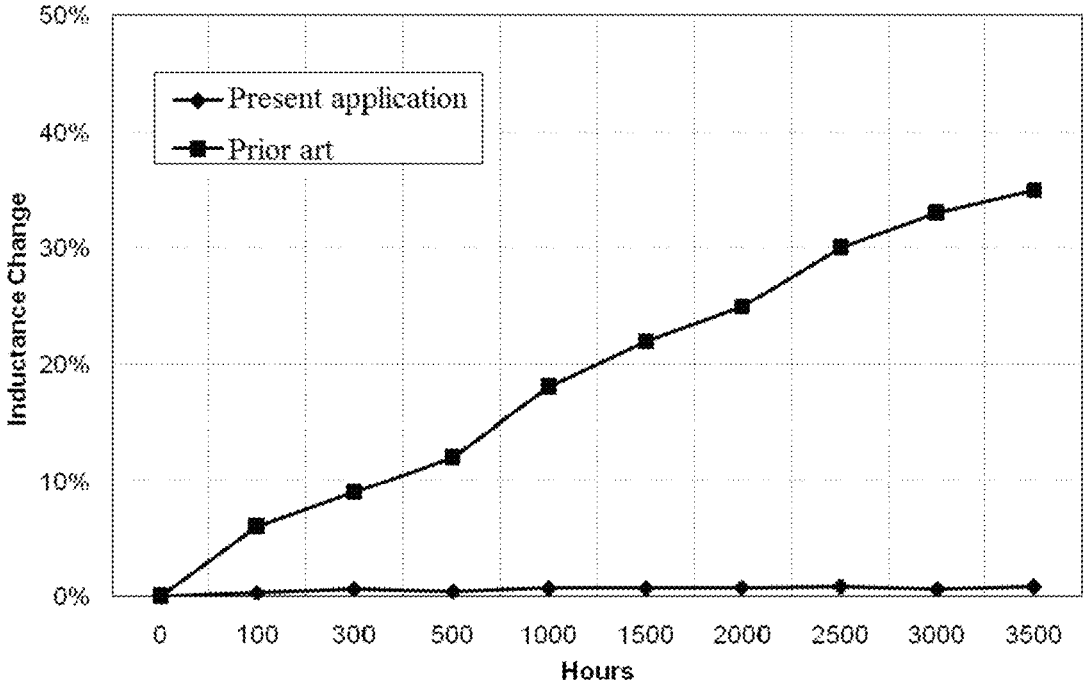
FIG. 4 is a graph comparing the high temperature (165° C.) aging test inductance values ("hours" vs "inductance change") of an inductor according to a specific embodiment of the present application with that of an existing powder integrally formed inductor.
Figure 5:
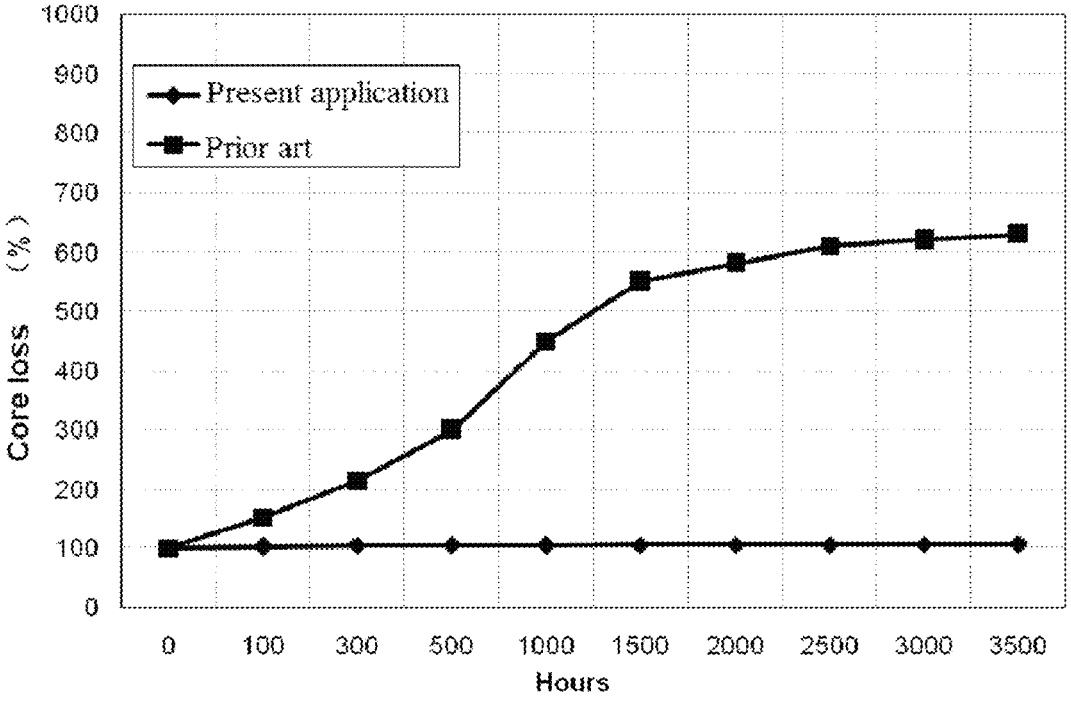
FIG. 5 is a graph comparing the high temperature (165° C.) aging test loss ("hours" vs "core loss") of an inductor according to a specific embodiment of the present application with that of an existing powder integrally formed inductor.

The present application will now be described in further detail with reference to the accompanying drawings and specific preferred embodiment.

The specific preferred embodiment of the application provides a preparation method of a metal soft magnetic composite material inductor, which includes the following steps of:

1) mixing and smelting Fe, Si and Cr according to the following proportion: 85-95 wt % of Fe, 4-10 wt % of Si and 1-5 wt % of Cr to obtain an alloy solution;

2) making the alloy solution into alloy powder in a water atomization or gas atomization mode; wherein, the alloy powder can be further subjected to heat treatment to remove stress;

3) sifting the alloy powder into a first powder of 15-45 μm, a second powder larger than 45 μm and a third powder smaller than 15 μm according to the particle size;

4) mixing the first powder, the second powder and the third powder according to the following proportion: 60-80 wt % of the first powder, 5-20 wt % of the second powder, 15-35 wt % of the third powder to obtain a mixed powder, and carrying out coating insulation on the mixed powder, wherein, one way of the coating insulation is to add the mixed powder into resin mixed solution for mixing, the dosage of the resin mixed solution accounting for 1-5.5 wt % of the mixed powder; the resin mixed solution is formed by mixing solid resin and an organic solvent, and the solid resin contains a curing agent and a release agent; the solid resin accounts for 1-10 wt % of the resin mixed solution; the resin mixed solution is uniformly distributed on each powder in the mixing process, and the insulated powder is obtained after the organic solvent is completely volatilized; more preferably, the adopted solid resin can be liquefied at 60-200° C. and has a viscosity of 10,000-50,000 mPa·s after the liquefaction, so it needs to be stored under −5 refrigeration;

5) crushing, granulating and sifting the insulated powder sequentially to obtain granulation powder, and pressing the granulation powder into a material cake; wherein the present application does not limit the shape of the material cake, which is preferably similar to the shape of the storage bin; before the transfer molding process, the granulation powder is pressed into a material cake and then put into a storage bin, and the purpose is that a larger amount of granulation powder can be put into the storage bin with limited volume, and the method is also one aspect of improving the product density;

6) placing the prefabricated hollow coil assembly in a mold cavity, placing the material cake in a storage bin, liquefying the material cake into the mold cavity in a transfer molding process, and coating the coil assembly; wherein the adopted mold is an MGP mold, and when the transfer molding process is carried out, the temperature of the mold is set to 150-200° C. and the heat preservation time is 100-500 s, and the forming pressure intensity only needs 5-20 MPa;

7) curing and demolding, and removing a runner to obtain a semi-finished product; and 8) solidifying the semi-finished product and preparing an end electrode to obtain a finished inductor.

Hereinafter, the preparation method of the present application will be described by way of one specific embodiment, and various aspects of characteristics of the prepared inductor and the existing powder integrally formed inductor will be compared to verify the beneficial effects of the present application.

(1) Mix Fe, Si and Cr according to the proportion provided above to obtain an alloy solution, and then carry out water atomization to obtain alloy powder.

(2) sift the alloy powder into a first powder of 15-45 μm, a second powder larger than 45 μm and a third powder smaller than 15 μm according to the particle size.

(3) Mix the first powder, the second powder and the third powder according to a mass part ratio of 6:3:1 to obtain a mixed powder.

(4) Mix epoxy resin containing a curing agent and a release agent with alcohol according to a mass part ratio of 1:10 to obtain a resin mixed solution; add the resin mixed solution with 5.5% wt of the mixed powder for mixing to uniformly distribute the resin mixed solution on each powder, crushing and granulating is carried out after alcohol volatilizes completely, and finally the powder pass through a 100-mesh screen to obtain granulation powder.

(5) Press the granulation powder into a columnar material cake.

(6) Place a prefabricated hollow coil assembly into a mold cavity of an MGP mold, place the material cake in a mold filling port, namely a storage bin, set the mold temperature to be 180° C., the temperature to be kept for 300 s and the pressure intensity to be 12 MPa, and carry out the transfer molding process;

(7) Cure and demold, and remove a runner to obtain a semi-finished product.

(8) Bake the semi-finished product at 180° C. for 4 h for curing, and then prepare an end electrode to obtain a sample inductor.

Figure 6:
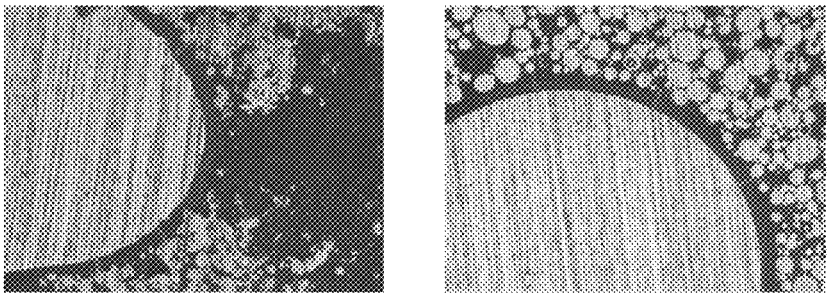
FIG. 6 is a graph comparing the damage of hollow coil skin film at the interior of an inductor according to a specific embodiment of the present application with that at the interior of an existing powder integrally formed inductor.

The characteristics of the sample inductor obtained by the above specific embodiment are tested in various aspects under the conditions of room temperature and 1 MHz, and compared with the characteristics of the inductor prepared by the existing powder integrally formed technology. Wherein the comparison between the inductor prepared by the above specific embodiment of the application and the inductor prepared by the existing art in five aspects of density, strength, saturation characteristics, high-temperature aging test inductance value and high-temperature aging test loss is respectively shown in FIGS. 1-5. FIG. 6 (*a*) is a graph showing the damage of coil skin film at the interior of an existing powder integrally formed inductor, and FIG. 6 (*b*) is a graph showing the damage of coil skin film at the interior of an inductor prepared by the above specific embodiment of the present application. It can be seen that by adopting the metal soft magnetic composite material (i.e. the granulation powder) of the present application, compared with the existing powder integrally formed inductor, the inductor prepared according to the preparation method of the present application has greatly improved density, strength and saturation current, and after a long-time aging test, the electrical property of the product is basically unchanged so that it can be seen that the reliability of the product is very high. Moreover, as can be seen from the comparison of FIG. 6, the damage of the coil shown in (a) is more obvious, and the damage of the coil shown in (b) is hardly visible, that is, the preparation method of the present application substantially improves the protection of the coil skin film and solves the pain point of the integrally formed inductor.

The foregoing is a further detailed description of the application in connection with specific preferred embodiments. It cannot be considered that the specific implementation of the present application is limited to these descriptions. For those skilled in the art to which the present application belongs, without departing from the concept of the present application, several equivalent substitutions or obvious variations can be made, and the same performance or use should be regarded as belonging to the protection scope of the present application.

What is claimed is:

1. A preparation method for a metal soft magnetic composite material inductor, comprising the following steps of:

1) mixing and smelting Fe, Si and Cr according to a following proportion: 85-95 wt % of Fe, 4-10 wt % of Si and 1-5 wt % of Cr to obtain an alloy solution;
2) making the alloy solution into alloy powder in a water atomization or gas atomization means;
3) sifting the alloy powder into a first powder of 15-45 μm, a second powder larger than 45 μm and a third powder smaller than 15 μm according to particle size;
4) mixing the first powder, the second powder and the third powder according to a following proportion: 60-80 wt % of the first powder, 5-20 wt % of the second powder, 15-35 wt % of the third powder to obtain a mixed powder, and carrying out coating insulation on the mixed powder;
5) crushing, granulating and sifting insulated powder sequentially to obtain granulation powder, and pressing the granulation powder into a material cake;
6) placing a prefabricated hollow coil assembly in a mold cavity, placing the material cake in a storage bin, liquefying the material cake into the mold cavity in a transfer molding process, and coating the coil assembly;
7) curing and demolding, and removing a runner to obtain a semi-finished product; and
8) solidifying the semi-finished product and preparing an end electrode to obtain a finished inductor, wherein in step 4), the mixed powder is added into a resin mixed solution for coating insulation; wherein a dosage of the resin mixed solution accounts for 1-5.5 wt % of the mixed powder; the resin mixed solution is formed by mixing a solid resin with an organic solvent wherein the solid resin contains a curing agent and a release agent, and the solid resin accounts for 1-10 wt % of the resin mixed solution.

2. The preparation method of claim 1, wherein step 2) further comprises heat treating the alloy powder to remove stress.

3. The preparation method of claim 1, wherein the solid resin is liquefied at 60-200° C. and has a viscosity of 10,000-50,000 mPa·s after liquefaction, and the solid resin is stored under −5° C.

4. The preparation method of claim 1, wherein in step 4), the mixed powder being added into a resin mixed solution for coating insulation comprises: mixing the mixed powder with the resin mixed solution, uniformly distributing the resin mixed solution on each powder, and finishing coating insulation after the organic solvent is completely volatilized.

5. The preparation method of claim 1, wherein in step 5) a 100-mesh screen is adopted during sifting.

6. The preparation method of claim 1, wherein in step 6) when the transfer molding process is carried out, a forming pressure intensity is 5-20 MPa, a temperature of a mold is 150-200° C. and a heat preservation time is 100-500 s.

* * * * *